US006644410B1

(12) United States Patent
Lindsey-Curran et al.

(10) Patent No.: US 6,644,410 B1
(45) Date of Patent: Nov. 11, 2003

(54) MODULAR SUBSEA CONTROL SYSTEM

(75) Inventors: Christopher John Lindsey-Curran, 1646 Harvard St., Houston, TX (US) 77008; Earl V. Schultz, Jr., 3402 Deer Valley, Spring, TX (US) 77373; John C. MacNeill, Sugarland, TX (US)

(73) Assignees: Christopher John Lindsey-Curran, Houston, TX (US); Earl V. Schultz, Jr., Spring, TX (US); John C. MacNeil, Sugar Land, TX (US)

( * ) Notice: Subject to any disclaimer, the term of this patent is extended or adjusted under 35 U.S.C. 154(b) by 213 days.

(21) Appl. No.: 09/626,978

(22) Filed: Jul. 27, 2000

(51) Int. Cl.[7] ..... E21B 29/12
(52) U.S. Cl. ..... 166/360; 166/341; 166/338
(58) Field of Search ..... 166/360, 344, 166/338, 341, 342; 405/169, 170

(56) References Cited

U.S. PATENT DOCUMENTS 4,444,218 A * 4/1984 Baugh ..... 137/236.1
4,601,608 A * 7/1986 Ahlstone ..... 405/169
4,661,017 A * 4/1987 Wood et al. ..... 405/169
4,682,913 A * 7/1987 Shatto et al. ..... 405/169
4,732,215 A * 3/1988 Hopper ..... 166/366
4,863,314 A * 9/1989 Baugh ..... 405/191
4,878,783 A * 11/1989 Baugh ..... 405/169
4,899,822 A 2/1990 Daeschler et al. ..... 166/339
5,456,313 A * 10/1995 Hopper et al. ..... 166/97.1
6,024,514 A * 2/2000 Ostergaard ..... 405/170
6,161,618 A * 12/2000 Parks et al. ..... 166/351
6,484,806 B2 * 11/2002 Childers et al. ..... 166/351

* cited by examiner

*Primary Examiner*—Thomas B. Will
*Assistant Examiner*—Thomas A. Beach
(74) *Attorney, Agent, or Firm*—Wendy Buskop; Buskop Law Group, P.C.

(57) ABSTRACT

A modular control system having independently and separately retrievable parts for use on subsea equipment, including subsea Christmas trees, and subsea manifolds.

20 Claims, 10 Drawing Sheets

MODULAR SUBSEA CONTROL SYSTEM

BACKGROUND OF THE INVENTION

1. Field of the Invention

The present invention relates to a modular control system having a housing and inner modules, for use with subsea installations or for use in harsh weather conditions such as on oil and gas rigs wherein one or more of the inner modules may be removed and replaced without having to shut down the entire control system.

The invention relates to a subsea Christmas tree using the unique modular control system. The invention further relates to a manifold which is operated using the inventive modular control system. The invention also relates to a distribution unit having a modular control system.

2. Background of the Invention

Various control systems usable for harsh environments have existed for some time, see for example U.S. Pat. No. 4,899,822 which is incorporated herein by reference. Most references simply teach mounting entire, watertight control systems on a subsea installation, such as a Christmas tree, or on an oil rig without being able to remove separate components.

SUMMARY OF THE INVENTION

The present invention is directed to a modular control system having a main outer housing, a plurality of removable modules, wherein each inner module comprises a rear side, a front side, two sidewalls and a top and a bottom. The rear side is constructed to support a hydraulic connector or an electrical connector or both which can engage control valves. The connectors can be attached with pressure-balanced couplings and a retaining device or latching assembly can be used to hold the inner modules into the outer housing. Handles or similar devices can be installed on the inner module so an ROV (Remotely Operated Vehicle) can be used to engage or detach the inner modules separately, without the need to remove all modules from the outer housing.

The elements of the modular control system can include solenoid control valves, many other valves, various sensors and filter elements for use in operation of the subsea well head.

It is an object of the invention to provide detachable modular control units which are capable of multiple functions such as valve control, pressure monitoring, fluid filtration, flow measurement, chemical injection dosage rate control, pressure monitoring, signal dampening, signal amplification, and various other subsea or drilling related functions.

It is an object of the present invention to provide a subsea installation having separate individual detachable electronic control modules which can be installed by an ROV on a subsea installation with each module capable of controlling a plurality of operating functions and a plurality of control valves.

A further object of the present invention is to provide mountable electronic modules which are detachably mounted on the subsea installation and capable of receiving signals from a host or a subsea master control stations for the control and command of adjacent or remote control valves or other electronic components which are incorporated into the detachable subsea modules.

An object of the invention is to have easily replaceable components, which are watertight and capable of being pulled and re-engaged by a remotely operated vehicle, or a diver.

Other objects and advantages of the invention will become apparent from the attached description, figures and appended claims.

DETAILED DESCRIPTION OF THE PREFERRED EMBODIMENTS

Figure 1:
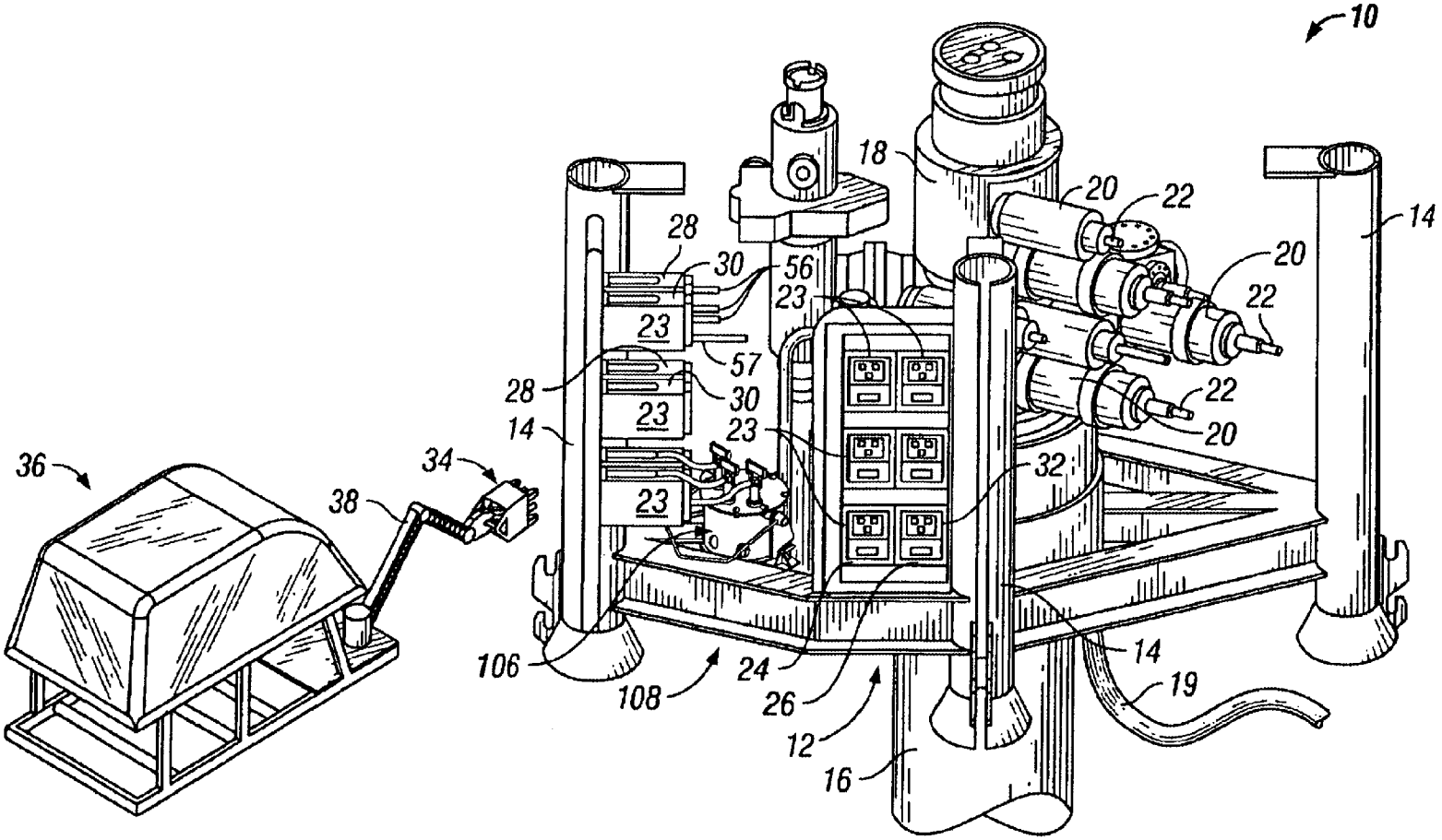
FIG. 1 is a perspective view of a subsea installation with a grouping of the retrievable modules secured to the installation.
Figure 2:
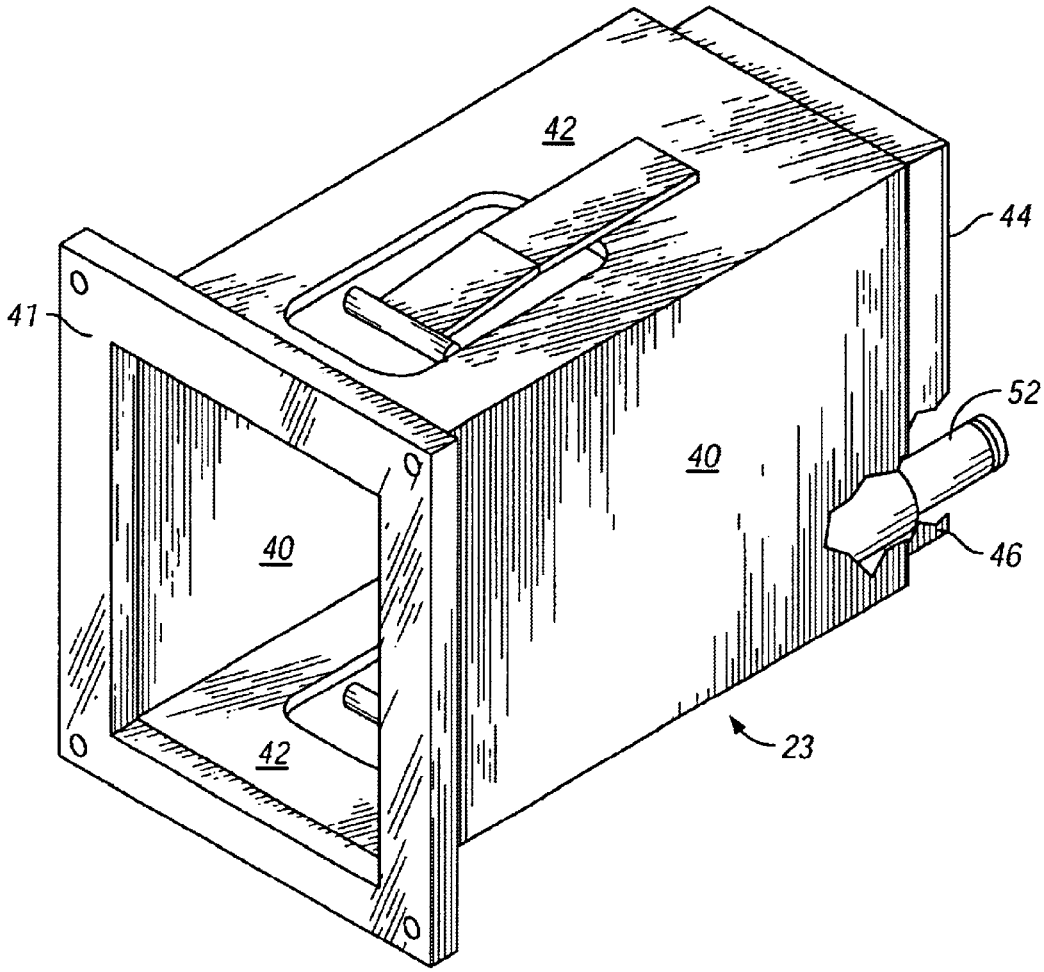
FIG. 2 is a perspective view of the outer housing of the modular control apparatus which receives the inner module.
Figure 3:
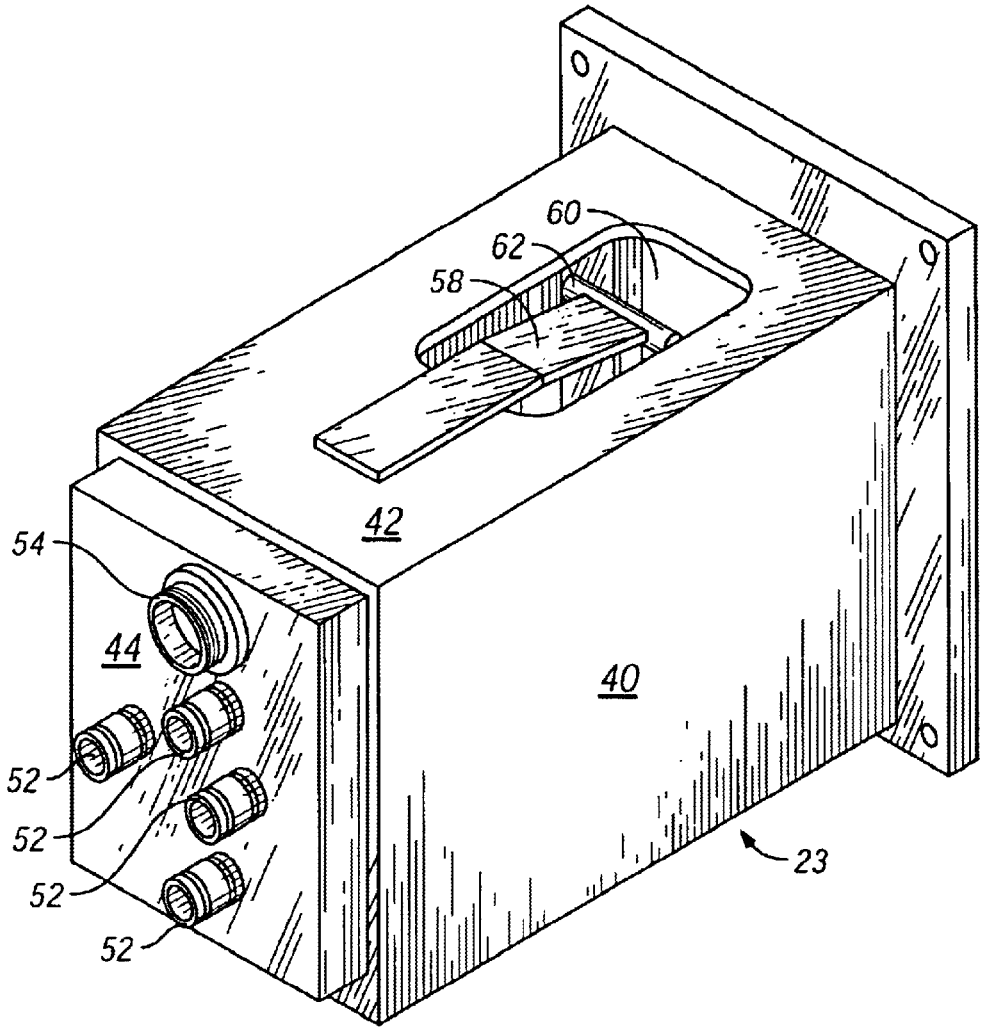
FIG. 3 is a perspective view from the opposite end of the housing of FIG. 2.

Referring to FIGS. 1, 2 and 3, the present invention is constructed of a plurality of modular units, called inner modules (34) inserted in a housing (23) which can be installed on a base, such as a subsea installation (10) such as a wellhead.

The installation (10) typically is devised with a plurality of valves for operating the well. Oil may flow from the wellhead to a tree via a subsea pipeline and then to a drilling rig. The installation (10) typically has a base, (12), with supporting beams or legs (14), preferably at least four columns. The subsea wellhead is shown generally as (16) and has a Christmas tree (18) positioned on it including a plurality of fluid operated valves (20). The valve can be of a standard form including a production wing valve, an annulus wing valve (for controlling flow out of pipelines), bypass valves connecting the pipeline and other valves, typically up to five other kinds of valves, which may be annulus swab valves, annulus master valves, production valves or other control valves with hydraulic actuators. Many valves can be controlled by the modular control system with the most preferred number of valves being between 15 and 30 valves. Flowline (19) extends to and from subsea installations such as wellheads. Control lines (22) extend from valves (20).

The unique modular control system consists in the most preferred embodiment of a plurality of generally rectangular housings (23) which may be referred to herein as the outer housings. In one embodiment, the housings are arranged in vertical columns or banks. Four vertical columns of outer housings are shown in FIG. 1 as housings (24), (26), (28) and (30).

As shown in FIGS. 1, 2 and 3, each outer housing preferably has four sides, a first side wall (40), a top side (42), a rear side (44) and a second side wall (202) and a front side (41) and a bottom side (43). Rear side (44) has a plurality of fittings or couplings, hereafter called connectors which can be hydraulic fluid connectors (52) and electrical connectors (54). Electrical control lines (57) extend from electrical connectors (54) to the electronic modules outer housing (108). Hydraulic control lines (56) extend from hydraulic connectors (52) to control lines (22) on valves (20) or to other members to be controlled on the installation. Top side (42) or alternately on the bottom side (43) or both, may have a restraining mechanism (58) for holding the inner module to the outer housing, which can be spring loaded. The spring (62) of the mechanism (58) can extend through a slot (60) located in the topside (42) or the bottom side (43) of the inner module (34).

Figure 4:
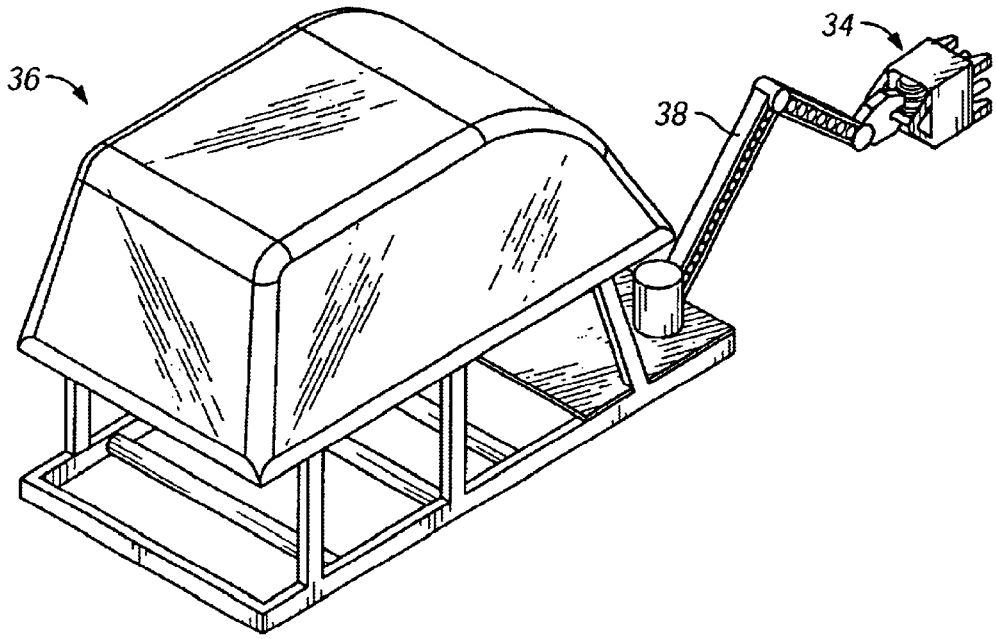
FIG. 4 is a perspective view of a typical inner module shown disconnected from the subsea installation and held by a ROV.
Figure 5:
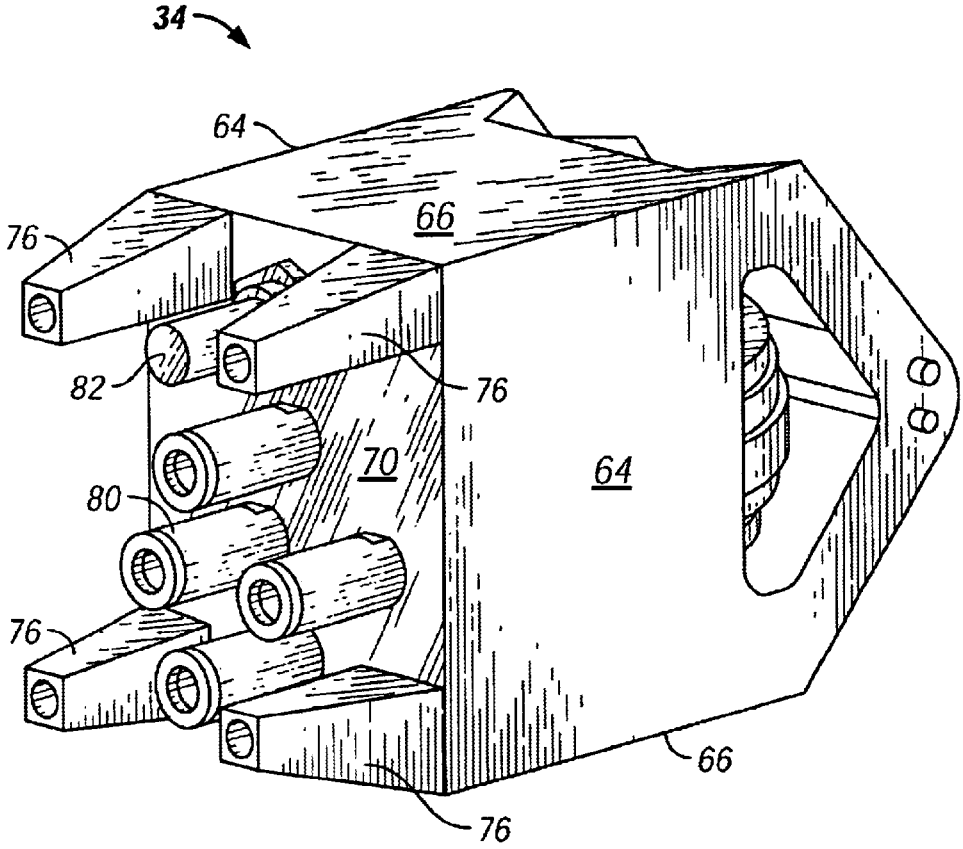
FIG. 5 is a perspective view taken from the opposite end of the inner module shown in FIG. 4 with pressure balanced couplings for the hydraulic fluid lines and the electrical control lines shown extending from the module.

Referring now particularly to FIGS. 4 and 5, a typical, inner module (34) such as for monitoring and controlling control valves, is illustrated having a generally rectangular body with an inner module first side wall (64), and inner module second side wall (65) an inner module third side wall (66) and inner module fourth side wall (67). Corner guide members (76) are angled and extend from inner end (70) to guide inner module (34) into outer housing (23).

Figure 6:
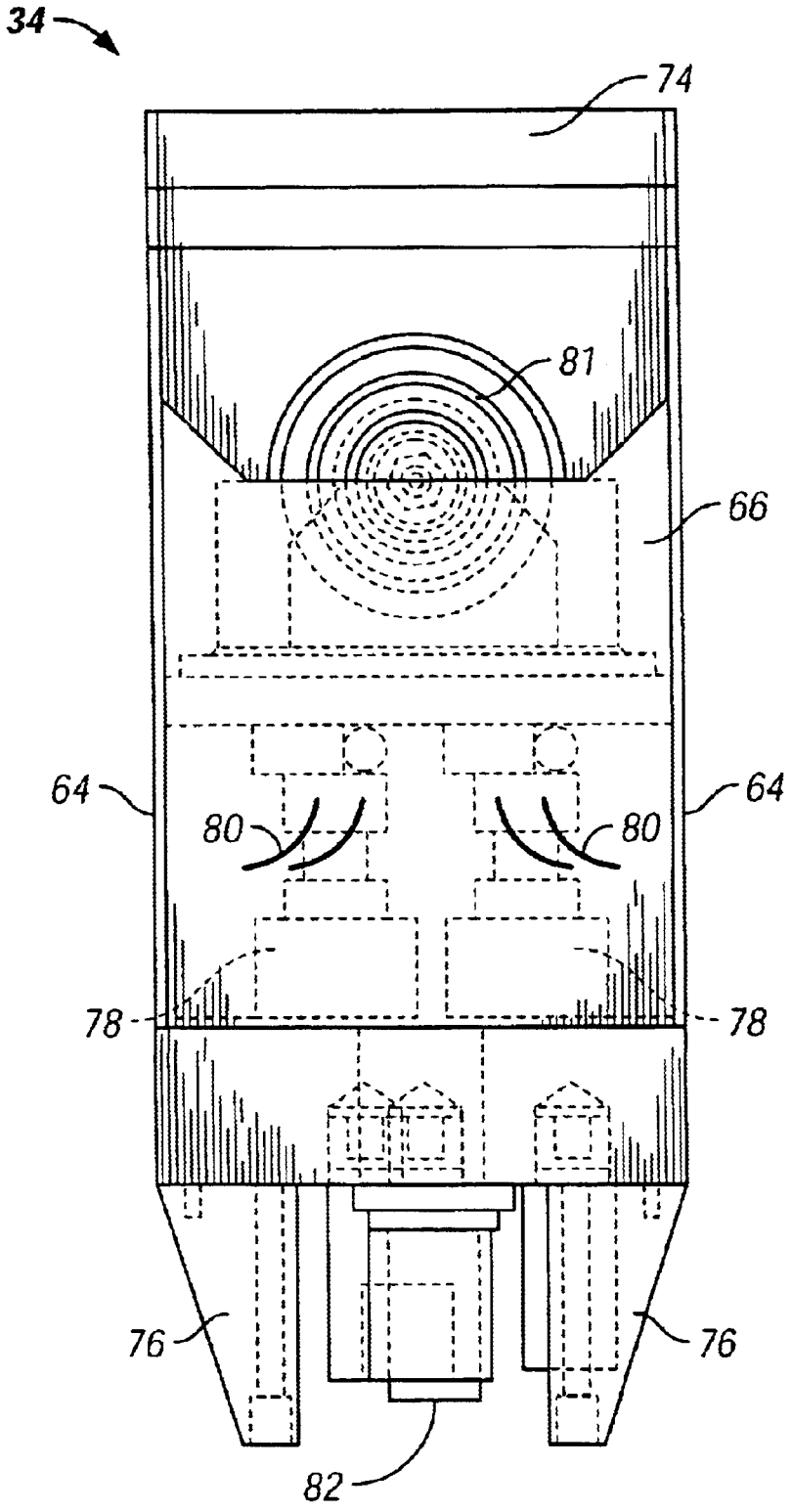
FIG. 6 is a top view of the inner module of the modular control system with a solenoid attached.
Figure 7:
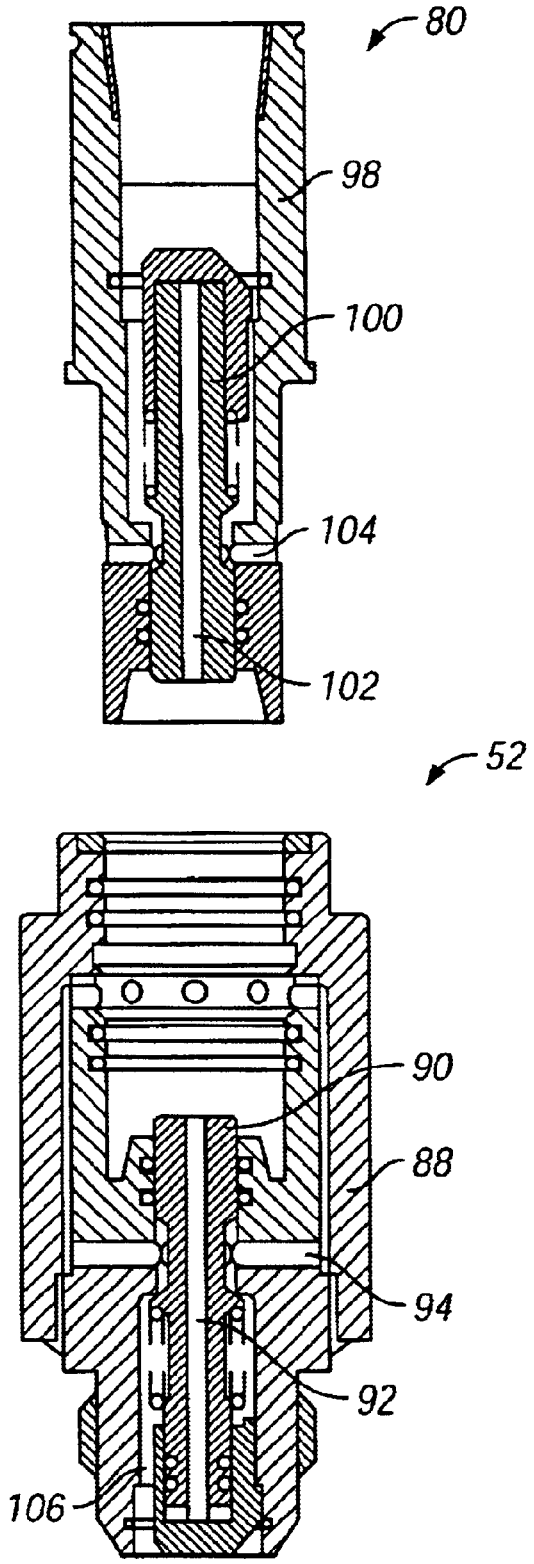
FIG. 7 is a cross-sectional view of a pressure balanced coupling in the disconnected position.

FIG. 6 shows a pair of control valves (78) controlled by solenoids (79) with electrical leads (80) extending from the solenoids (79). FIG. 7 shows an embodiment with a pressure compensator (81) mounted on inner module (34) for internal pressure equalization in a subsea environment.

The modular control apparatus could be attached, such as by flanges or bolted in a conventional matter to the base of the installation. Installations for which this device is conceived as particularly usable include subsea Christmas trees, or subsea manifolds. The present invention is also usable on oil rigs, and in highly corrosive and harsh environments, such as chemical plants, or near dangerous reactors which require operators to be in protective suits or having to use robots to operate in or near the equipment. The control systems are contemplated for use with electrical, optical, hydraulic or chemical control.

The modular sensor apparatus must be designed from strong materials, such as stainless steel, or other corrosive resistant materials, which include composites, and coatings corrosion resistant coatings. The structure of the outer housing must be capable of supporting intense subsea pressures, including depths of up to 10,000 feet. The structures and their coatings also are contemplated to be able to sustain bad weather including hurricane conditions and chemically corrosive environments.

The inner modules (23) can have any one of a variety of shapes. In a preferred embodiment, the modules and housing are rectangular in shape, however they can be cylindrical, particularly if the inner module is an electronic module.

If rectangular inner module and housing shapes are used, it is envisaged that the inner module will have two sloping angled portions or arms. In between the arms, which extend and then a handle can be disposed between the arms for engagement by an ROV. The slope of these angles may range from 90 to 180 degrees which enables ease of insertion of the inner module (34) into the outer housing (23). However, it is fully within the scope of the present invention that the inner modules could be of different shapes for example, the outer housings (23) and inner modules could be cylindrical, pyramidal, conical, cubical, square pyramids or other geometric shapes.

The inner modules preferably have at one end, various kinds of attaching means that enable the pulling or pushing of the inner modules into the outer housings. A handle (74) is shown in FIG. 1 and can be used effectively on the inner module particularly, by an ROV when a human hand can not be used with the handle.

Preferably the handle (74) is of a shape such that it can be used by a ROV or by a suited diver, or a one atmosphere diving suit, which acts like a manned vehicle, needing to use a hook or similar non-human device to engage and re-engage the inner module in the housing. It is also possible, that cables could be used as the attaching means, or hooks, rather than handles to engage or disengage the inner modules (34).

In one embodiment of the present invention contemplates an outer housing (23) with a rear side (44) where pressure balanced couplings can be located so that hydraulic connections and electrical connections can be removably secured to the outer housing. It is contemplated that the pressure balanced couplings enable the inner module to simply snug into the pressure balanced couplings, permitting a secure connection to the hydraulic connections and the electrical connectors.

A latching assembly (58) is contemplated to hold the inner module (34) removably into the outer housing (23). The latching assembly (58) can be made of various materials, including but not limited to a spring, a retainer bar, or a strap. FIG. 3 shows the latching assembly.

The inner module can be constructed to be used as a filter module, a sensor module, a chemical injection module, a pressure intensifier module, a crossover module for redundancy in an application and spare modules of various types.

Figure 8:
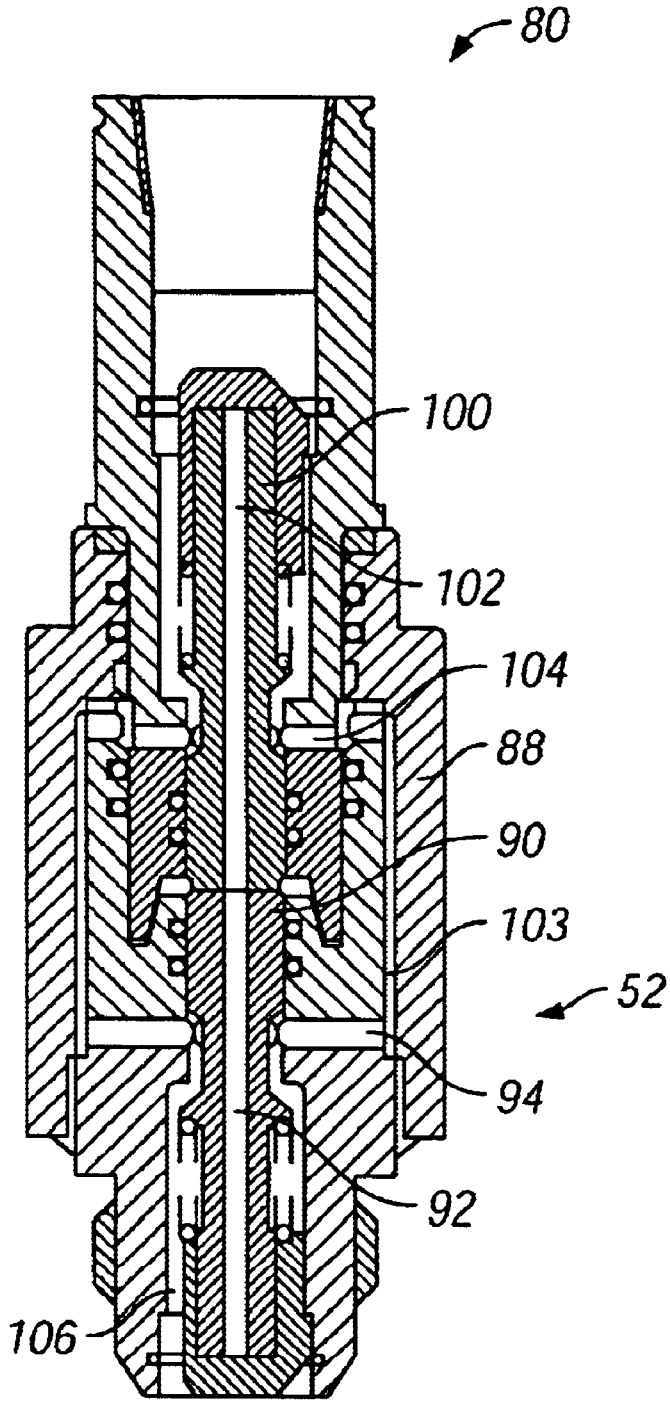
FIG. 8 is a cross-sectional view of the pressure balanced coupling of FIG. 7 in the connected position.
Figure 9:
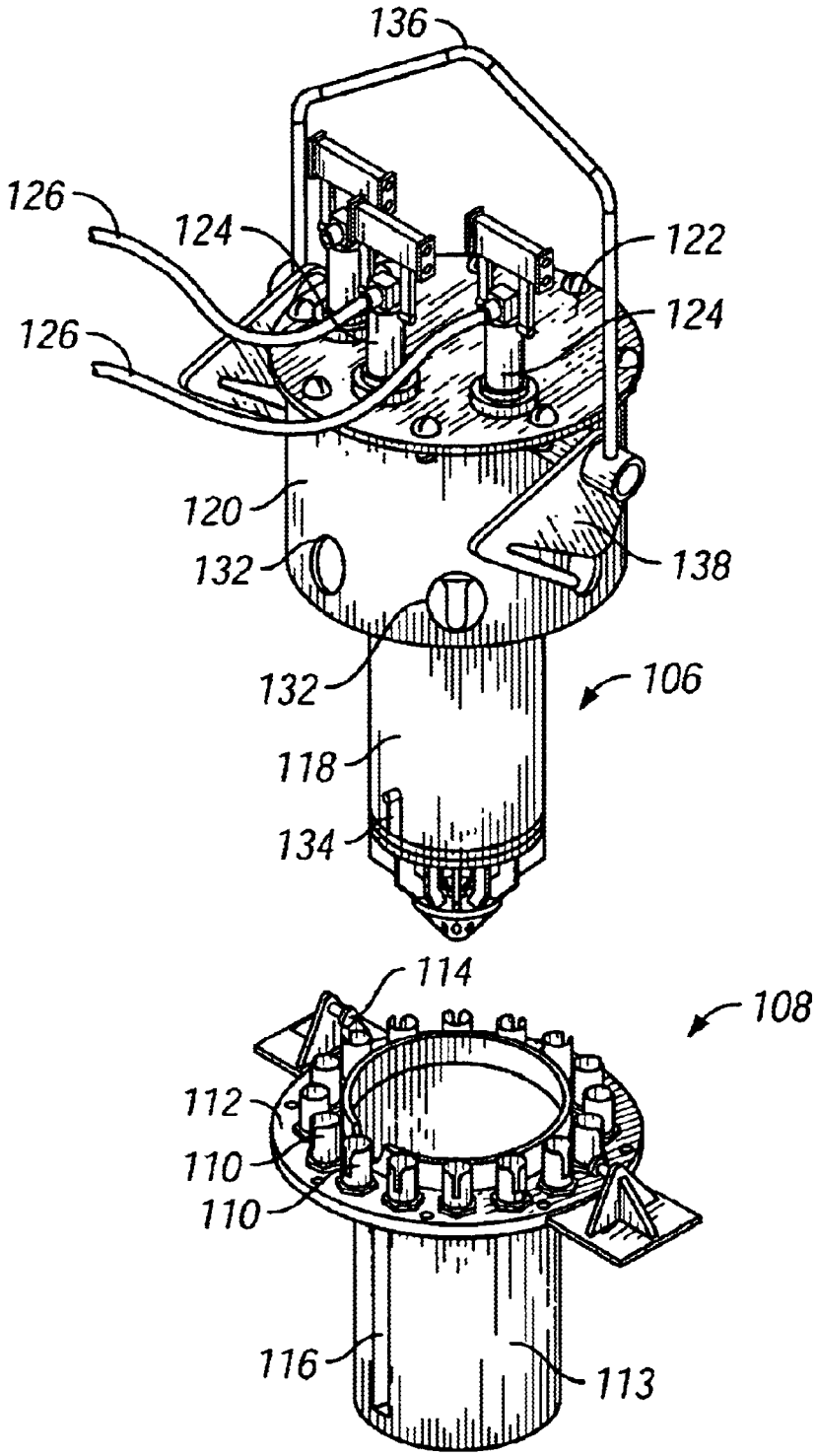
FIG. 9 is a perspective view of an embodiment of the two components of the electronic module of the invention.

Referring to FIGS. 7 and 8, pressure balanced hydraulic connectors (52) on outer housing (23) and inner module (34) are illustrated. Connector (52) for outer housing (23) in this embodiment features an outer female sleeve (88) and a piston (90) mounted for sliding movement. Piston (90) has an axial bore (92) in fluid communication with port (94). Male coupling (80) has a covering (98) receiving a piston (100). Piston (100) has a central bore (102) and port (104) in fluid communication with bore (102). Upon stabbing or inserting male coupling (80) within connector (52) as shown in FIG. 9, the ends of pistons (90) and (100) engage each other as shown to move pistons (90) and (100) to an open position to permit fluid flow past pistons (90) and (100). Hydraulic fluid flows from male coupling (80) through ports (104).

The Electronic Module

In FIG. 9, an embodiment of the inner module is shown which contains a body in which a microprocessor, a valve driver, a sensor and other electronic elements may be housed. The valve driver should be capable of controlling between one and 300 valves, more preferably between four and forty valves.

In FIG. 9, an electronic module (106) receives electrical power and signals from a host station along with multiplexed communications. Electronic module (106) decodes the signals and transmits signals to other modules such as module remote units located on other subsea installations or satellites. An optical fiber line may be used to receive multiplexed communication from the subsea host station and surface facility.

Figure 10:
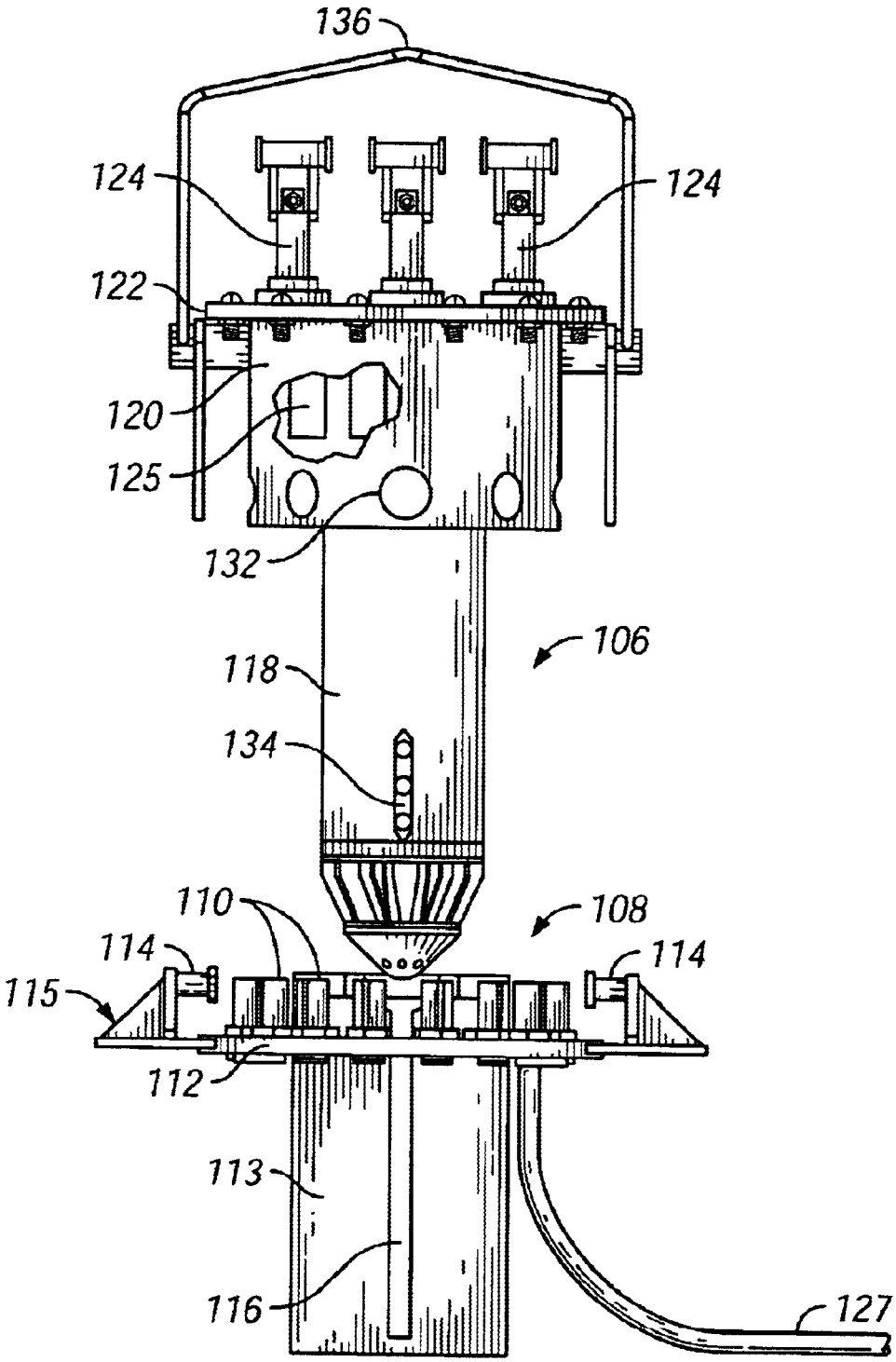
FIG. 10 is the side elevational view of the housing and module of FIG. 9.

In FIG. 10, electrical connection (124) connects with inner electronic module (106). Power and signal are received through connector (124) transmitted through a second electrical connector (125) into a third electrical connector (110) enabling the signal to travel through the electrical cable (127) to electrical connectors on the outer housing. A plate (122) can be used as the base to contain connectors (124). The latching mechanism (115) has a pin (114) and a handle (136) for securing the inner electronic module (106) to the landing base (108). Sleeve (120) protects the connectors (125) during the installation of the module. Ports (132) are used to verify when inner electronic module (106) is fully mated to the landing base (108). A one atmosphere housing (118) is preferably used to contain a subsea modem (not shown). Alignment key (134) is used to orient electronic module (106) to landing base (108). Alignment key (134) particularly aligns to slot (116) in lower portion (113) of landing base (108).

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A modular control system comprising:

i) an outer housing capable of receiving an inner module;

ii) an inner module, with each inner module consisting of:

a) a rear side;

b) a first side;

c) a second side;

d) a top;

e) a bottom; and f) a front side;

iii) at least one connector secured to said rear side of said inner module for engaging said outer housing;

iv) a coupling for engaging said connectors of said inner module and said outer housing;

v) control means secured in said inner module for opening, closing, monitoring, and measuring the status of valves and similar devices on said modular control system;

vi) a restraining device to restrain said inner module in said outer housing; and vii) handling means extending from said first side to said second side for use in installation or removal.

2. The modular control system of claim 1, wherein said connectors are for electrical and hydraulic connections.

3. The modular control system of claim 1, wherein said handling means is capable of engaging to a remotely operated vehicle or a tool used in installation.

4. The modular control system of claim 3, wherein the handling means is a profile.

5. The modular control system of claim 1, wherein said restraining device comprises at least one latching assembly for securing said inner module into said housing.

6. The modular control system of claim 1, wherein said restraining device comprises a spring engagable latching assembly located on said top and said bottom of said inner module and interlocks with slots located in opposing sides of said outer housing.

7. The modular control system of claim 1, wherein said inner module front side further includes a mounting assembly for securing said inner module to an installation.

8. The modular control system of claim 1, wherein said inner module first side and said second side each comprises an edge with an angled portion which facilitates insertion of said inner module into said outer housing.

9. The modular control system of claim 1, wherein said inner module further comprises a microprocessor.

10. The modular control system of claim 2, wherein the couplings for the hydraulic connectors are pressure balanced.

11. A modular subsea control system for controlling a subsea installation on the sea floor comprising:

a) a subsea master control station for providing control signals to the subsea installation for control;

b) an umbilical from said subsea master control station to a surface location which acts as a source;

c) a modular subsea control system connected to said subsea master control station:

i) a housing for containing an inner module; and ii) an inner module for removably connecting to said housing, and wherein said inner module and said housing comprise connectors for interengaging with each other and with said umbilical, couplings for said connectors, control means for receiving and transferring hydraulic and electrical signals from sensors located on said subsea installation to and from the surface location;

iii) a valve driver for controlling between valves on the subsea installation; and iv) a handling means for receiving a connection from a remotely operated underwater vehicle, whereby the remotely operated underwater vehicle can engage said inner module and independently recover and replace individual inner modules.

12. The modular subsea control system of claim 11, wherein the signals which are related to electrical, hydraulic, optical or chemical control.

13. The modular subsea control system of claim 11, wherein said inner module further comprises a microprocessor.

14. The modular subsea control system of claim 11, wherein said inner module further comprise guides for alignment of said inner module with said housing.

15. The modular subsea control system of claim 11, wherein said inner module has a body with a first part for housing electronic elements; and for removably securing to a second part for said housing.

16. The modular subsea control system of claim 11, wherein a pressure-compensating device provides additional protection from severe conditions to said inner module.

17. The modular subsea control system of claim 11, wherein said connectors are secured to said inner module.

18. The modular subsea control system of claim 11, further comprising an electronic module having a latching assembly for securing said electronic module to said outer housing.

19. The modular subsea control system of claim 11, wherein said valve driver can control between one and three hundred valves.

20. The modular subsea control system of claim 16, wherein said body is cylindrical.

* * * * *